US007422209B2

(12) United States Patent
Hashimoto

(10) Patent No.: US 7,422,209 B2
(45) Date of Patent: Sep. 9, 2008

(54) SHEET CONVEYING APPARATUS AND IMAGE FORMING APPARATUS

(75) Inventor: Tatsuaki Hashimoto, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 524 days.

(21) Appl. No.: 10/885,719

(22) Filed: Jul. 8, 2004

(65) Prior Publication Data

US 2005/0035539 A1 Feb. 17, 2005

(30) Foreign Application Priority Data

Jul. 17, 2003 (JP) ..... 2003-198786

(51) Int. Cl.
*B65H 7/02* (2006.01)

(52) U.S. Cl. ..... 271/228; 271/273

(58) Field of Classification Search ..... 271/226, 271/227, 228, 272, 273, 274
See application file for complete search history.

(56) References Cited

U.S. PATENT DOCUMENTS 5,094,442 A * 3/1992 Kamprath et al. ..... 271/227
5,557,369 A 9/1996 Shiga et al. ..... 355/204
5,673,911 A * 10/1997 Loftus et al. ..... 271/273
6,173,952 B1 * 1/2001 Richards et al. ..... 271/228

FOREIGN PATENT DOCUMENTS

JP 6-234441 8/1994
JP 10-67448 3/1998

* cited by examiner

*Primary Examiner*—Patrick Mackey
*Assistant Examiner*—Michael C McCullough
(74) *Attorney, Agent, or Firm*—Fitzpatrick, Cella, Harper & Scinto

(57) ABSTRACT

A sheet conveying apparatus has a detection unit for detecting an inclination to a sheet conveying direction of a sheet; an inclination correction unit for correcting the inclination of the sheet by rotating which nipping the sheet based on a detection signal from the detection unit; a first conveying unit, which nips and conveys the sheet upstream of the inclination correction unit; a first nipping release unit for releasing a nipping state of the first sheet conveying unit; a second conveying unit which is provided downstream of the inclination correction unit and nips and conveys the sheet; a second nipping release unit for releasing the nipping state of the second sheet conveying unit; and a control unit for controlling the first nipping release unit and the second nipping release unit to selectively release the sheet nipping state of the first sheet conveying unit and the second sheet conveying unit according to an inclination correction operation by the inclination correction unit.

10 Claims, 14 Drawing Sheets

SHEET CONVEYING APPARATUS AND IMAGE FORMING APPARATUS

This application claims priority from Japanese Patent Application No. 2003-198786 filed Jul. 17, 2003, which is hereby incorporated by reference.

BACKGROUND OF THE INVENTION

1. Field of the Invention

The present invention relates to a sheet conveying apparatus provided in an image forming apparatus, and more in particular, it relates to a constitution for correcting inclination (or skew) of the sheet to be conveyed.

2. Related Background Art

Conventionally, in general, an image forming apparatus and an image reading apparatus such as a copying machine, a printer, a facsimile, a scanner and the like comprise a sheet conveying apparatus for conveying a sheet such as a recording paper and an original to an image forming portion and an image reading portion. This sheet conveying apparatus is sometimes provided with correction means for performing a skew conveying correction of the sheet and a positional deviation correction of the sheet to align the attitude and position of the sheet before being conveyed to the image forming portion and the image reading portion.

Here, as for a correction system of such correction means, there are those using a registration roller pair, and for example, in the case of the image forming apparatus, a so-called loop registration system has become a mainstreamer, wherein a leading edge of the sheet is abutted against a nip of the registration roller pair at rest so as to cause a deflection on the sheet, and the leading edge of the sheet is allowed to run parallel with the roller nip by elasticity of the sheet so as to perform a correction of the skew conveying, and after that, the registration roller pair is rotated at a predetermined timing so as to establish a synchronization between the sheet and the image.

However, in such a loop registration system, a loop space for forming a loop has been certainly required, thereby making the apparatus large-sized. Further, when the loop space is not sufficiently secured, there is a problem in that a jam (sheet jam) due to a buckling particularly in the sheet such as a thin paper being weak in rigidity has occurred, and abnormal sound (so-called loop sound) has been emitted when the sheet was abutted against the registration roller pair.

Furthermore, there is a problem in that a skew conveying correction capability ends up being changed depending on strength of the sheet rigidity. To be more specific, in the case of the thin paper, which is weak in rigidity, the leading edge of the sheet lacks an abutting force when abutting against the registration roller nip, and there are some cases where the leading edge of the sheet does not sufficiently abut against the registration roller pair, and in this case, it is totally impossible to perform the skew conveying correction.

Further, in the case of a thick paper and the like which is strong in rigidity, there is a problem in that the sheet ends up going through the nip of the registration roller pair due to an impact caused by abutting against the nip of the registration roller. To prevent this from occurring, for example, when an attempt is made to give a load and the like to the registration roller pair by a brake member, it invites a cost-up of the product.

Still further, when there is a curl or a crease on the leading edge of the sheet, the leading edge of the sheet is unable to precisely run along the nip portion of the registration roller, and as a result, there arises a problem in that a precise correction of the skew conveying cannot be performed, thereby lowering a print accuracy.

On the other hand, in recent years, the image forming apparatus and the image reading apparatus have been digitalized to such an extent that, after an original is read once, its image information can be electrically encoded and stored in a memory. At an image forming time, the information inside the memory is read, and an image corresponding to the image information of the original is allowed to be formed on a photosensitive body by an exposing apparatus such as a laser beam, a LED array and the like. Hence, even in a plurality of copies, no mechanical movement such as an optical system is needed.

This has made it possible that a sheet interval, which is an interval between the sheets, is closed up, and a number of sheets are processed within a shortest possible time. As a result, for example, in the case of the image forming apparatus, at an image forming time, the substantial improvement of an image forming speed has come to be attempted without increasing a processing speed.

Nevertheless, in case of using an apparatus adopting the loop registration system described as above as the sheet conveying apparatus, a sheet is stopped once so as to form a loop, and therefore, a sheet interval is inevitably decided, thereby greatly affecting the improvement of the image forming speed (productivity).

Consequently, to overcome such a defect, a sheet conveying apparatus adopting the registration system so as to automatically reform the skew conveying of the sheet has been disclosed in Japanese Patent Application Laid-Open No. 10-067448.

Here, this sheet conveying apparatus comprises a conveying roller pair (registration rollers) for nipping and conveying the sheet, a sensor for detecting an amount of skew of the sheet provided at the downstream side in a conveying direction of the conveying roller, and correction means for correcting the inclination of the conveying roller such that the conveying roller is displaced so as to incline in a direction orthogonal to the conveying direction of the sheet, and in case of correcting the skew conveying of the sheet, based on the information of the skew amount detection sensor, the skew conveying of the sheet is corrected by displacing the conveying roller according to the inclination of the sheet.

However, in such a conventional sheet conveying apparatus for correcting the skew conveying of the sheet by displacing the conveying roller, at the time when the conveying roller is displaced so as to correct the skew conveying of the sheet, in the case where the leading edge of the sheet is nipped by the roller positioned at the downstream portionside in a conveying direction of the conveying roller or the tailing edge portion of the sheet is nipped by the roller positioned at the upstream side in the conveying direction of the conveying roller, for example, if the conventional sheet conveying apparatus is applied to the image forming apparatus, there occurs the tugging of the sheet between the rollers, and this causes problems such as the occurrence of a crease on the sheet, the correction of the skew conveying not adequately performed, the appearance of the distortion in the image, and the print accuracy remarkably poor.

SUMMARY OF THE INVENTION

Hence, the present invention has been made in view of the above-described situation, and the object of the invention is to provide a sheet conveying apparatus and an image forming apparatus, which can correct the skew conveying of a sheet without allowing the tugging of the sheet to occur.

The present invention has the following constitution in the sheet conveying apparatus for conveying the sheet by a plurality of sheet conveying means arranged along a sheet conveying path; comprising:

detection means for detecting an inclination in a sheet conveying direction of the sheet to be conveyed;

inclination correction means for correcting the inclination of the sheet by rotating the sheet in an inclined state in a state of being nipped based on a detection signal from the detection means;

first conveying means which is provided in the upstream of the inclination correction means and conveys the sheet toward the inclination correction means;

first nipping release means for releasing a nipping state of the first sheet conveying means;

second sheet convey means which is provided in the downstream side of the inclination correction means and conveys the sheet from the inclination correction means to the downstream side;

second nipping release means for releasing a nipping state of the second sheet conveying means; and control means for controlling the first nipping release means and the second nipping release means to selectively release the sheet nipping state of the first sheet conveying means and the second sheet conveying means according to the sheet inclination correction operation by the inclination correction means.

The present invention has the following constitution in the sheet conveying apparatus for conveying the sheet by a plurality of sheet conveying means arranged along the sheet conveying path, comprising:

a sheet position detection sensor which detects the inclination of the sheet to be conveyed in the sheet conveying direction;

a correction roller pair which is provided rotatably, and corrects the inclination of the sheet by rotating in a state of nipping the sheet in an inclined state based on the detection signal from the sheet position detection sensor;

a upstream roller pair provided in the upstream side of the correction roller pair, the upstream roller pair being separable;

a downstream roller pair provided in the downstream side of the correction roller pair, the downstream roller pair being separable; and wherein the upstream roller pair and the downstream roller pair are selectively separated according to the inclination correction operation of the sheet by the correction roller pair.

DESCRIPTION OF THE PREFERRED EMBODIMENTS

Embodiments of the present invention will be described below in detail with reference to the drawings.

First Embodiment

Figure 1:
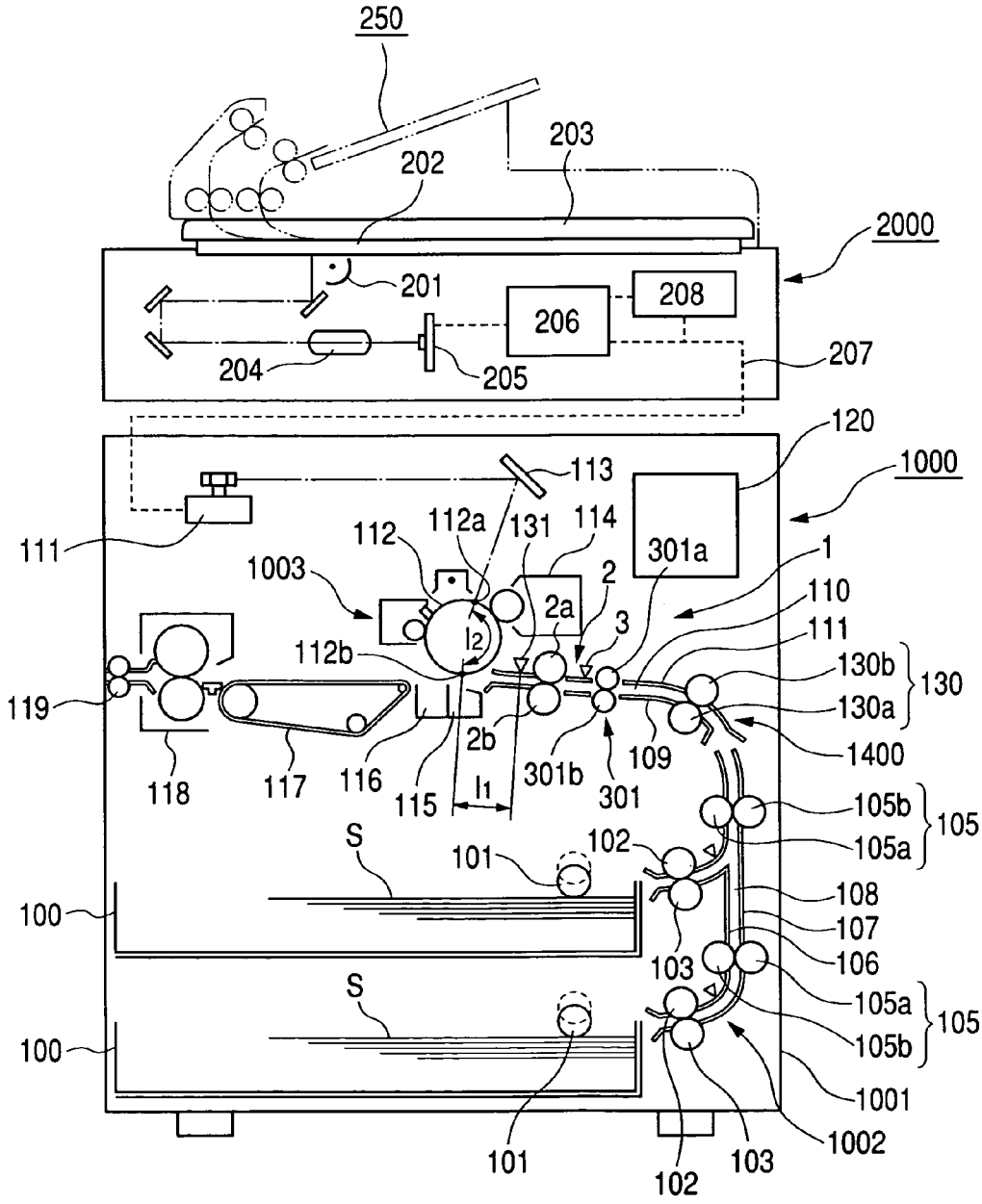
FIG. 1 is a sectional view of a printer which is one example of an image forming apparatus comprising a sheet conveying apparatus according to a first embodiment of the present invention.

FIG. 1 is a sectional view of a printer, which is one example of an image forming apparatus comprising a sheet conveying apparatus according to a first embodiment of the present invention.

In the drawing, reference numeral 1000 denotes a printer, and the printer 1000 comprises a printer body 1001 and a scanner 2000 arranged on the top surface of the printer body 1001.

Here, the scanner 2000 for reading an original comprises a scanning optical light source 201, a platen glass 202, an open-close original thick plate 203, a lens 204, a photodiode (photoelectric conversion) 205, an image processing portion 206, a memory portion 208 for storing an image processing signal processed at the image processing portion 206, and the like.

When reading the original, an illustrated original placed on the platen glass 202 is irradiated with light by the scanning optical light source 201 so as to be read. The read original image is processed by the image processing portion 206, and after that, it is converted into an electrical signal 207 electrically encoded, and is transmitted to a laser scanner 111, which is an image forming means. Note that the image information processed and encoded at the image processing portion 206 is stored once in the memory portion 208, and can be also transmitted to the laser scanner 111 by the signal from a controller 120 as occasion demands.

The printer 1001 comprises a sheet feeding apparatus 1002 for feeding a sheet S, a sheet conveying apparatus 1004 for conveying the sheet S fed by the sheet feeding apparatus 1002 to an image forming portion 1003, the controller 120 as control means for controlling the printer 1000, and the like.

Here, the sheet feeding apparatus 1002 comprises a separation portion consisting of a cassette 100, a pick up roller 101, a feed roller 102, and a retard roller 103. The sheets S inside the cassette 100 are allowed to be separated and fed one sheet by one sheet by the operation of the pick up roller 101 moving up and down and rotating at a predetermined timing and the separation portion.

The sheet conveying apparatus 1004 comprises a conveying roller pair 105 and a inclination correction roller portion 1 having a upstream roller pair 130 and a downstream roller pair 2. The sheet S fed from the sheet feeding apparatus 1002 passes through a sheet conveying path 108 constituted by guide plates 106 and 107 by the conveying roller pair 105, and after that, it is transferred to a sheet conveying path 110 constituted by guide plates 109 and 111, and then, is led to the inclination correction roller portion 1. In this inclination correction roller portion 1, the sheet S has a skew conveying and a positional deviation corrected as to be described later, and after that, it is conveyed to the image forming portion 1003.

The image forming portion 1003 comprises a photosensitive drum 112, the laser scanner 111, a developing device 114, a transfer charger 115, a separation charger 116, and the like. At the time of an image formation, a laser beam from the laser scanner 111 is turned back by a mirror 113, and is irradiated to an exposing position 112*a* on the photosensitive drum rotating clockwise, thereby forming a latent image on the photosensitive drum, and moreover, the latent image formed on the photosensitive drum in this manner is subsequently allowed to be visualized as a toner image by the developing device 114.

Note that this toner image on the photosensitive drum is subsequently transferred on the sheet S by a transferring charger 115 in a transfer portion 112*b*. Further, the sheet S transferred with the toner image in this manner is electrostatically separated from the photosensitive drum 112 by the separation charger 116, and after that, it is conveyed to a fixing apparatus 118 by a conveying belt 117 so that a fixing of the toner image is performed, and then it is discharged by a discharge roller 119.

Note that, in FIG. 1, reference numeral 131 denotes an exposing start sensor for detecting the sheet S having passed through the restoration roller pair 2, and when this exposing start sensor 131 detects the sheet S having passed through the downstream roller pair 2, the irradiation of the laser beam by the laser scanner 111 is started.

Here, a distance 11 from the exposing start sensor 131 to a transfer portion 112*b* is arranged at a position equal to a distance 12 from the laser beam irradiation position 112*a* of the photosensitive drum 112 to the transfer portion 112*b*, and this makes it possible to establish a synchronization between the sheet S and the leading edge position of the image on the photosensitive drum 112.

Note that, in the present embodiment, though the printer body 1001 and the scanner 2000 are a separate body, there are sometimes the cases where the printer body 1001 and the scanner 2000 are in one united body. Further, regardless of whether the printer body 1001 is a body separate from the scanner 2000 or in one united body with the scanner 2000, if the processing signal of the scanner 2000 is inputted to the laser scanner 111, the scanner functions as a copying machine, and if the transmission signal of a FAX is inputted, it functions as the FAX. In addition, if the output signal of a personal computer is inputted, it functions as a printer.

On the other hand, if the processing signal of an image processing portion 206 of the scanner 2000 is transmitted to another FAX, it functions as the FAX. Further, in the scanner 2000, if an original automatic feeding apparatus 250 as shown by a two-dot chain line is mounted, the original can be automatically read.

Figure 2:
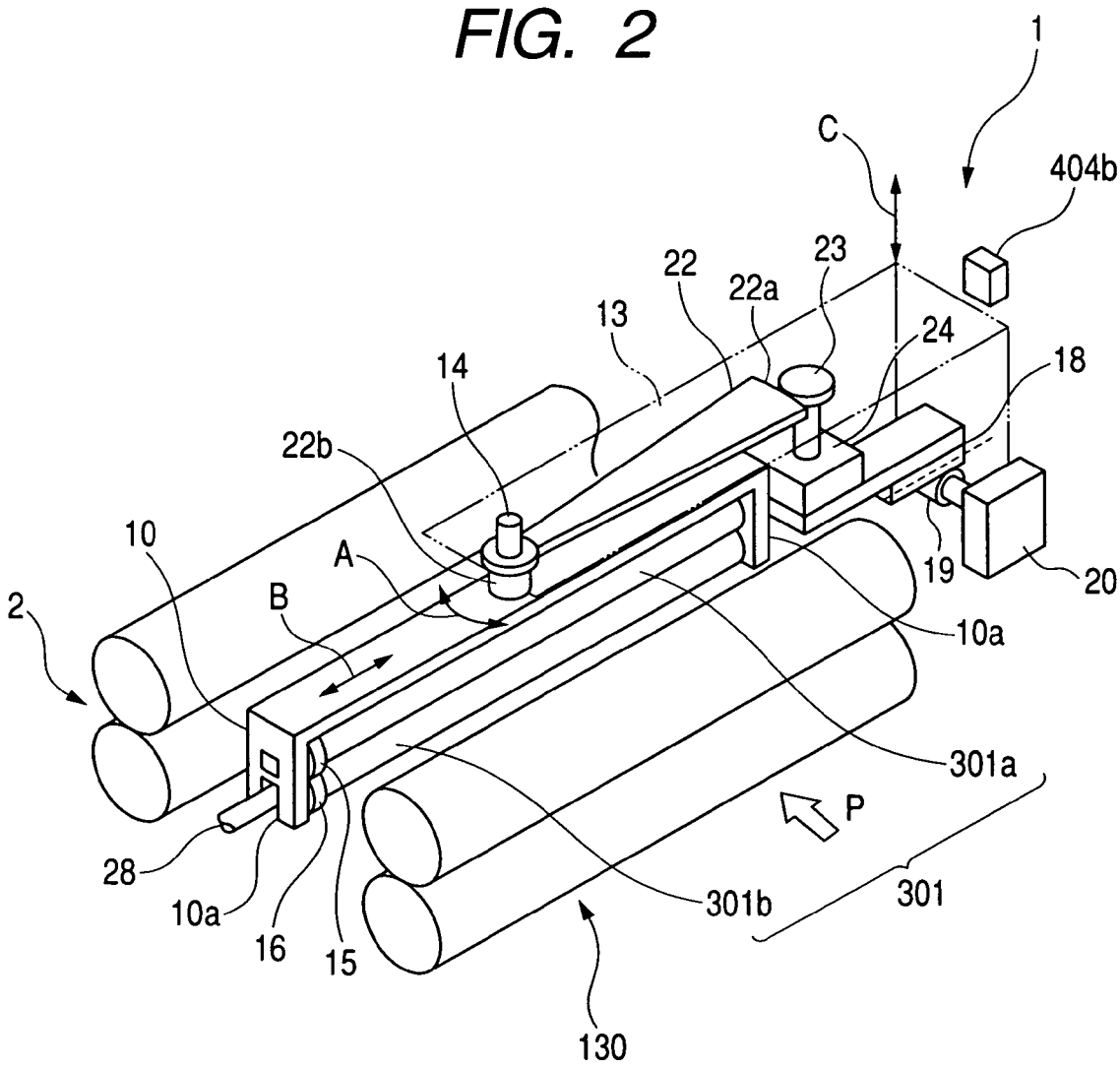
FIG. 2 is a perspective view of a inclination correction roller portion of the sheet conveying apparatus.
Figure 3:
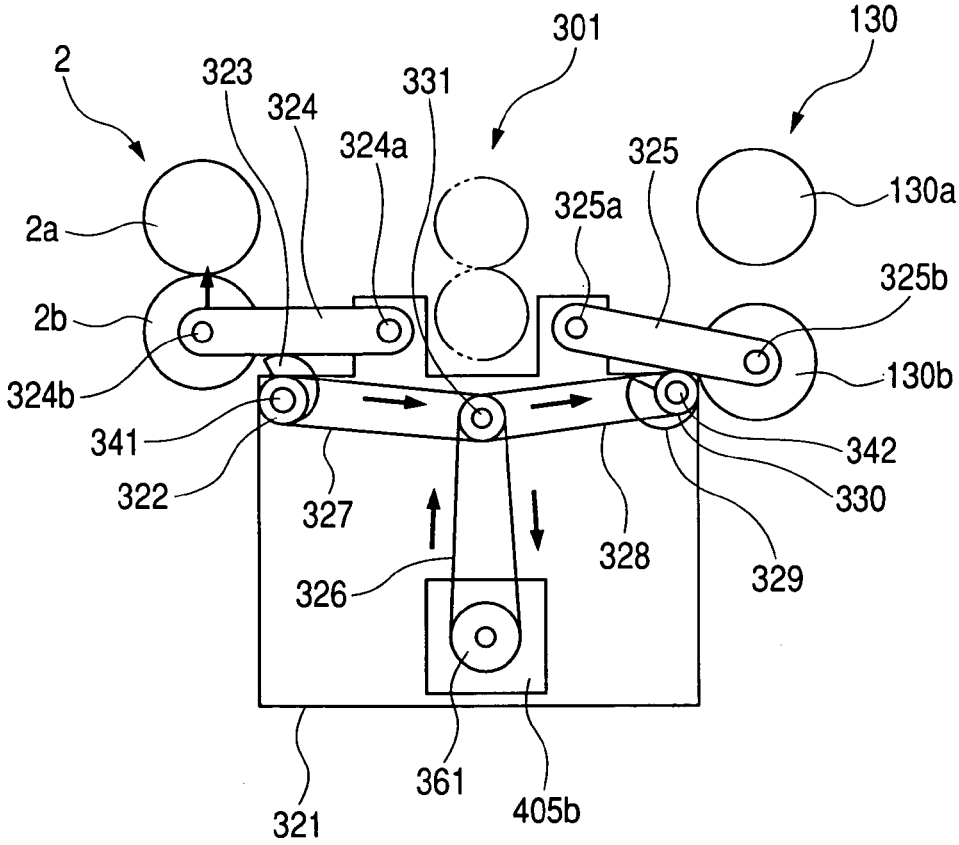
FIG. 3 is a side view of the inclination correction roller portion of the sheet conveying apparatus.
Figure 4:
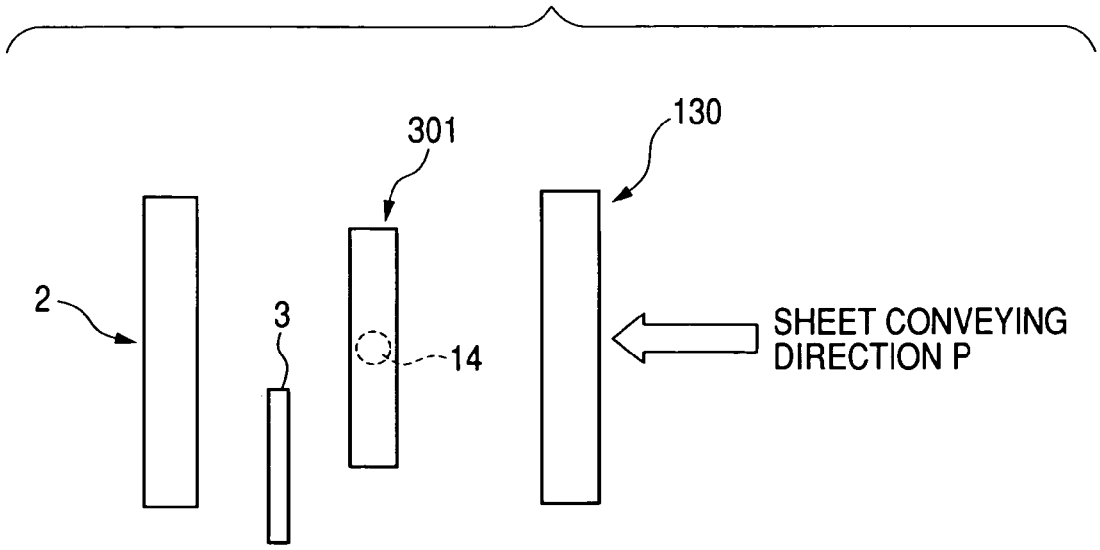
FIG. 4 is a plan view showing a positional relationship between each roller of the inclination correction roller portion of the sheet conveying apparatus and a position detection sensor.

FIG. 2 is a perspective view of a inclination correction roller portion 1, FIG. 3 is a side view thereof, and FIG. 4 is a plan view showing a positional relationship between each roller of the inclination correction roller portion 1 and a position detection sensor to be describer later.

In FIGS. 2 to 4, reference numeral 301 denotes a correction roller pair which is inclination correction means constituted by correction rollers 301*a* and 301*b* which are two rotational members separably press-contacted. This correction roller pair 301 is arranged between the upstream roller pair 130 which is first sheet conveying means arranged at the upstream side and the downstream roller pair 2 which is second sheet conveying means arranged at the downstream side.

Here, as shown in FIG. 2, correction rollers 301*a* and 301*b* are mounted with gears 15 and 16, respectively at its one side, and the correction gears 301*a* and 301*b* are constituted by these gears 15 and 16 such that they are synchronized so as to be rotated. Further, a driving force from an unillustrated conveying motor is transmitted to a shaft 28 of the lower correction roller 301*b*, and this allows the correction roller pair 301 to rotate in a sheet conveying direction.

Reference numeral 10 denotes a frame which rotatably holds the upper correction roller 301*a* from among the correction roller pair 301 by both bent end portions 10*a*, and is fixed with an arm 22, on top of which is formed a rack gear portion 22*a* in the upper surface center portion. This frame 10 allows an engaging portion 22*b* formed on the arm 22 to engage with a rotational shaft 14 provided on a stay 13, thereby being able to rotate with the rotational shaft 14 as a center.

Here, the rack gear portion 22*a* of the arm 22 engages with a gear 23 fixed on the output shaft of a swing motor 24, and when the swing motor 24 is driven in this manner, the frame 10 integral with the arm 22 swings (rotates, or pivotally moves) in a direction of an arrow mark A, and accompanied with this, the correction roller pair 301 is allowed also to swing (rotate, or pivotally moves) in a direction of the arrow mark A, that is, in a direction at angle with the direction orthogonal to the sheet conveying direction P.

On the other hand, the stay 13 is fixed with a rack gear portion 18, and this rack gear portion 18 is engaged with a lateral moving drive gear 19 which is fixed to the output shaft of a lateral moving motor 20 fixed to the printer body 1001.

When the lateral moving motor 20 rotates, the rotation of this lateral moving motor 20 is transmitted to the stay 13 through a lateral register drive gear 19 and the rack gear portion 18, and this allows the stay 13 to move to a thrust direction which is the direction orthogonal to the sheet conveying direction P indicated by an arrow mark B, and the movement of this stay 13 allows the correction roller pair 301 also to move in the thrust direction.

Further, this stay 13 is made movable up and down in an arrow mark direction C by a lift motor 404*b* and an unillustrated cam mechanism, and by moving the stay 13 up and down in this manner, the upper correction roller 301*a* can be separated and press-contacted with respect to the lower correction roller 301*b*. This constitution is corresponding to correction nipping release means of the present invention.

Note that the correction roller pair 301 has the nip line held by the controller 120 at a home position, which is parallel with a rotational center shaft of the photosensitive drum 112 or the nip line of the downstream roller pair 2 based on the signal from an unillustrated home position sensor at least before the conveyance of the sheet S starts.

On the other hand, as shown in FIG. 3, the downstream roller pair 2 consists of two downstream rollers 2*a* and 2*b*, and the lower downstream roller 2*b* from among two downstream rollers 2*a* and 2*b* constituting the downstream roller pair 2 is rotatably held on a movement end portion of a first pressure arm 324 swinging up and down with a shaft 324*a* provided on the upper portion of a fixed base 321 as a point of support. By swinging up and down this first pressure arm 324, the lower downstream roller 2*b* is allowed to press-contact or separate with respect to the upper downstream roller 2*a*.

Further, the upstream roller pair 130 is constituted by two upstream rollers 130*a* and 130*b*, and the lower upstream roller 130*b* from among two upstream rollers 130*a* and 130*b* constituting the upstream roller pair 130 is rotatably held on the movement end portion of a second pressure arm 325 swinging up and down with a shaft 325*a* provided on the upper portion of a fixed base 321 as a point of support. By swinging up and down this second pressure arm 325, the lower upstream roller 130*b* is allowed to press-contact or separate with respect to the upper upstream roller 130*a*.

In FIG. 3, reference numeral 405*b* denotes a press-contacting/separating motor fixed to the printer body 1001, and a belt pulley 361 is fixed on the output shaft of this press-contacting/separating motor 405*b*. A belt 326*b* is suspended between this belt pulley 361 and a center pulley 331 provided on the upper portion of the fixed base 321.

Further, a belt 327 is suspended between the center pulley 331 and a pulley 322 mounted on a rotational shaft 341 provided at the side of the downstream roller pair of the fixed base 321, and a belt 328 is suspended between the center pulley 331 and a pulley 330 mounted on a rotational shaft 342 provided at the side of the upstream roller pair of the fixed base 321. Further, the rotational shaft 341 at the side of the downstream roller pair is mounted with the first pressure arm 324 and a cam 323 abutting from below, and the rotational shaft 342 at the side of the upstream roller pair is mounted with the second pressure arm 325 and a cam 329 abutting from below.

When the belt pulley 361 is rotated clockwise by the press-contacting/separating motor 405*b* and the belt 326 is driven in the arrow mark direction in the drawing, the drive of this belt 326 allows the cam 323 to rotate integrally with the pulley 322 through the center pulley 331 and the belt 327 in the arrow mark direction, and by the rotation of the cam 323, the first pressure arm 324 is pushed upward as shown in the drawing, and the lower downstream roller 2*b* is press-contacted to the upper downstream roller 2*a*.

Further, at the same time, the drive of the belt 326 allows the cam 329 to rotate integrally with the pulley 330 through the center pulley 331 and the belt 328, and by the rotation of this cam 329, as shown in the drawing, the second pressure arm 325 is lowered downward by a dead weight or an unillustrated biasing means, and the lower upstream roller 130*b* is separated from the upper upstream roller 130*a*.

Note that, after that, when the press-contacting/separating motor 405*b* is further rotated (or rotated in reverse), by the operation of the cams 323 and 329, the first pressure arm 324 is lowered downward by the dead weight or the unillustrated biasing means, and is separated from the upper downstream roller 2*a*, and the lower upstream roller 130*b* is press-contacted to the upper upstream roller 130*a*.

In this manner, in the present embodiment, by the press-contacting/separating motor 405*b*, which is the same drive means, the press-contact and separation of the upstream roller pair 130 and the downstream roller pair 2 can be controlled. Note that, by changing the respective phases of the cams 323 and 329, it is possible to push upward the lower downstream roller 2*b* and the lower upstream roller 130*b* in a pressuring direction at the same time or move them in a separating direction at the same time. Further, the press-contact and separation are possible at a different timing. Note that the constitution allowing these upstream roller pairs 130 to be separated is corresponding to the first nipping release means of the present invention, and the constitution separating the downstream roller pair 2 is corresponding to the second nipping release means of the preset invention.

Further, in FIG. 4, reference numeral 3 denotes a sheet position detection sensor for detecting an inclination to the sheet conveying direction of the leading edge of the sheet S conveyed by the correction roller pair 301 and a positional deviation of the side end in a direction orthogonal to the sheet conveying direction of the sheet S. A sheet position detection sensor 3 constituting this detection means is arranged in a direction orthogonal to the sheet conveying direction at the downstream side of the conveying direction of the correction roller pair 301.

Figure 5:
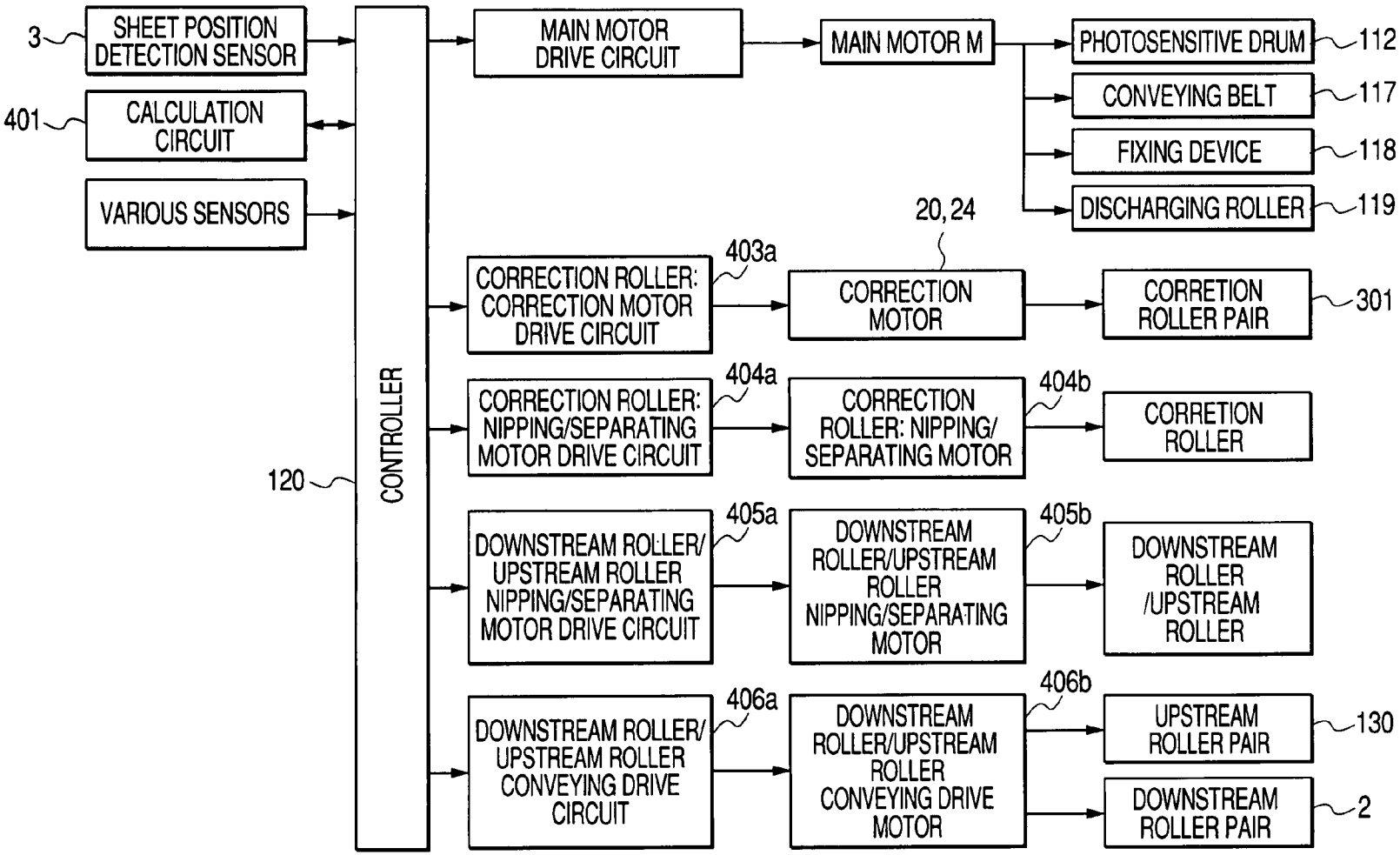
FIG. 5 is a control block diagram of the printer.
Figure 6:
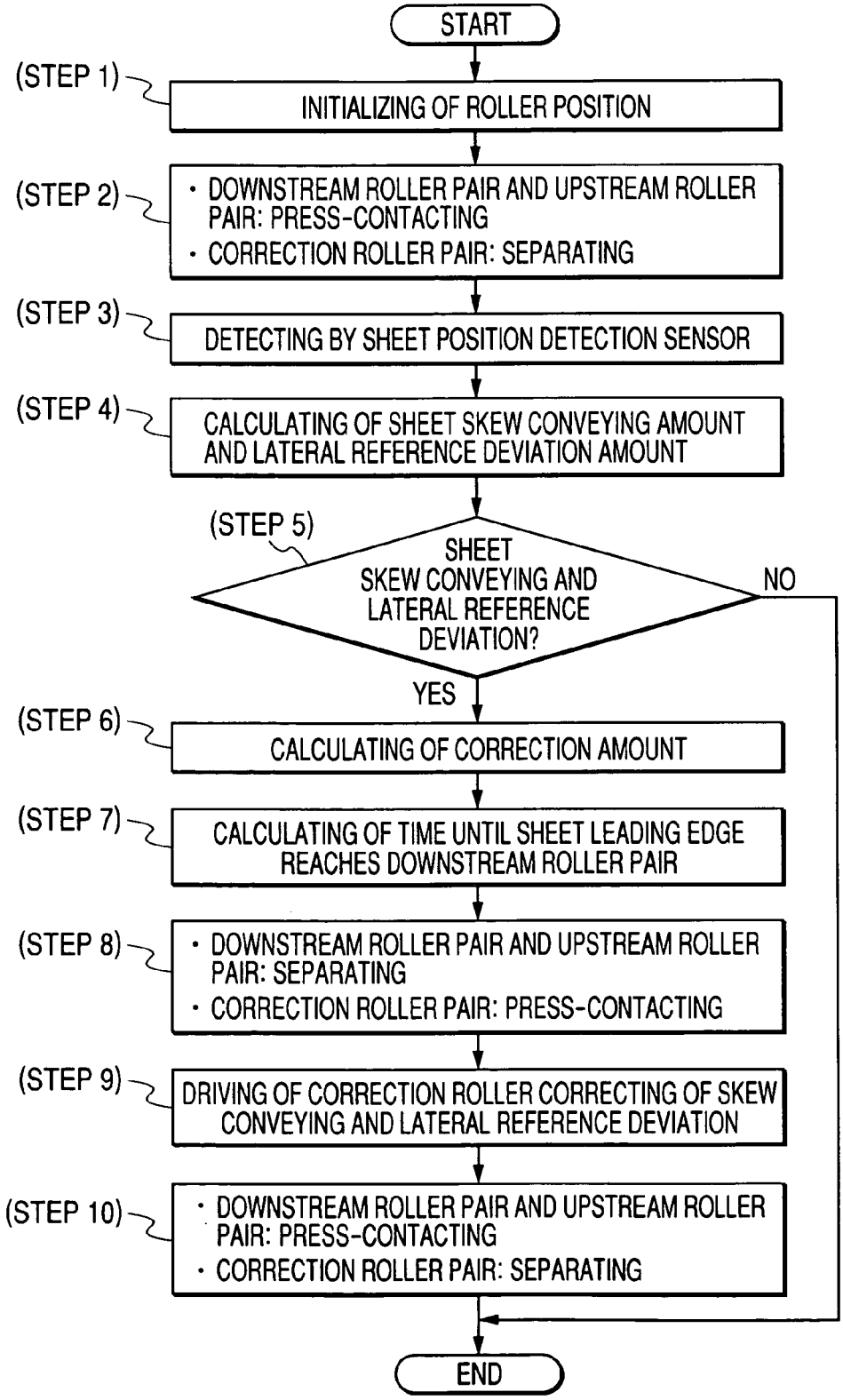
FIG. 6 is a flowchart to explain about a skew conveying correction operation of the sheet conveying apparatus.

FIG. 5 shows a control block diagram of the printer 1000 comprising such a sheet conveying apparatus 1004 and the like, and as shown in the drawing, the photosensitive drum 112, the conveying belt 117, the fixing apparatus 118, and the discharge roller 119, all of which are previously described, are directly connected to a main motor M, and each element is possible to rotate in synchronization with the main motor M.

Further, the controller 120, which is control means, is connected with the sheet position detection sensor 3 and other various sensors, and is inputted with the detection signals, respectively, which are obtained by the sheet position detection sensor 3 and the like. In the controller 120, for example, the amount of inclination of the sheet S is calculated by a calculation circuit 401 based on the detection signal from the sheet position detection sensor 3.

Further, the controller 120 is connected to the lateral moving motor 20 which is a correction motor, the swing motor 24, a motor 404*b* for use of correction roller pressure, the press-contacting/separating motor 405*b* for use of the downstream roller pair 2 and the upstream roller pressure, and a conveying drive motor 406*b* for driving the correction roller pair 301, respectively through the drive circuits 403*a*, 404*a* and 406*a*, and outputs a necessary control signal based on the detection result of the sheet position detection sensor 3, thereby allowing respective motors 20, 24, 404*b*, 405*b* and 406*b* to drive for a predetermined amount.

Next, the skew conveying correction operation of the printer 1000 (sheet conveying apparatus 1004) having such a constitution will be described with reference to the flowchart shown in FIG. 6, and FIGS. 7A and 7B, and FIGS. 8A and 8B.

First, when an unillustrated start button of the printer 1000 is pushed, the lateral moving motor 20 and the swing motor 24 are driven, and by an unillustrated home position sensor, the initializing operation of the swing direction of the correction roller pair 301 and the position in a thrust direction is performed (Step 1).

Accompanied with this initializing operation, the motor 404*b* (refer to FIG. 2) is driven, and the upper correction roller 301*a* is lifted so as to separate from the lower correction roller 301*b*. Further, the press-contacting/separating motor 405*b* is driven so that a downstream roller pair 2 and the upstream roller pair 130 are press-contacted to one another (Step 2).

Figure 7A:
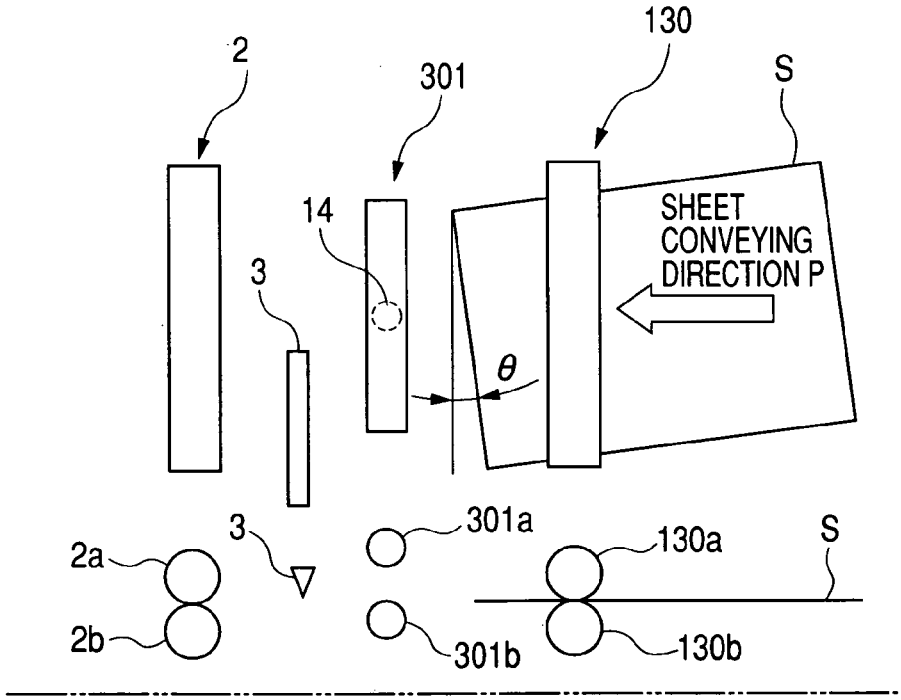
FIGS. 7A and 7B are a first drawing to explain about the skew conveying correction operation of the sheet conveying apparatus.

In this state, as shown in FIG. 7A, when the sheet S skewed by an angle θ (degrees) from the sheet conveying direction P is conveyed, this sheet S advances into the nip portion of the upstream roller pair 130 and is nipped there. After that, the sheet S nipped by the upstream roller pair 130 is conveyed along the sheet conveying direction P and advanced while remaining in an inclined state so as to be detected by the sheet position detection sensor 3 arranged in the downstream side of the upstream roller pair 130 (Step 3).

Here, the detection signal from this sheet position detection sensor 3 is inputted to the controller 120, and by the calculation circuit 401 of the controller 120, a passing time point of the sheet leading edge, the inclination of the sheet S nipped by the correction roller pair 301, and the amount of lateral reference deviation are calculated (Step 4).

Next, the controller 120 determines the existence or non-existence of the skew conveying and the lateral reference deviation of the sheet S from this calculation result (Step 5), and if there exists no skew conveying nor any lateral reference deviation of the sheet S (N of Step 5), no correction operation is performed, but if there exist the skew conveying and the lateral reference deviation of the sheet S (Y of Step 5), the amount of correction related to this, that is, the amount of driving of the lateral moving motor 20 and the swing motor 24 is calculated (Step 6).

Figure 7B:
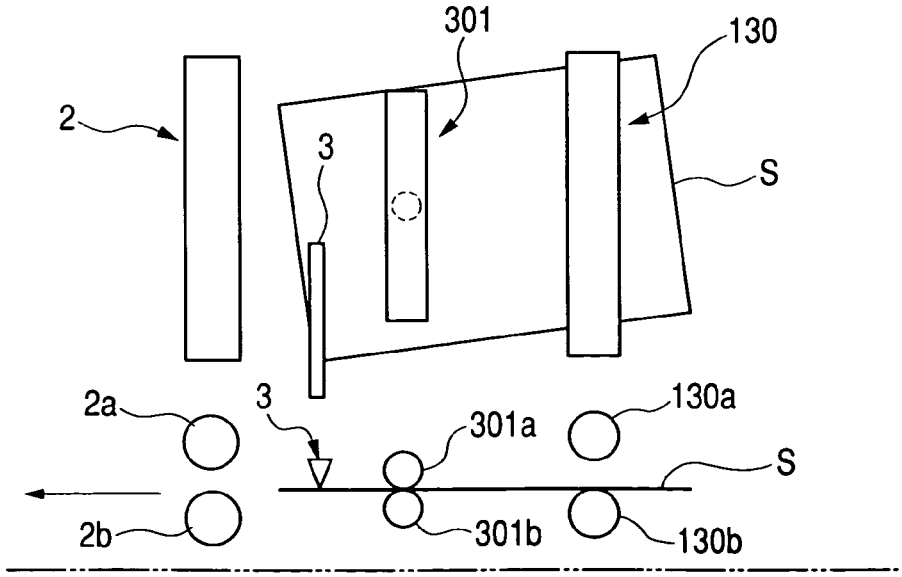

Next, the time until the leading edge of the sheet S reaches the downstream roller pair 2 is calculated (Step 7), and after that, as shown in FIG. 7B, the press-contacting/separating motor 405*b* is driven so as to separate the downstream roller pair 2 and the upstream roller pair 130, respectively, and release the sheet nipping state, and the motor 404*b* is driven so that the correction roller pair 301 is press-contacted and put into a state of nipping the sheet (Step 8).

Figure 8A:
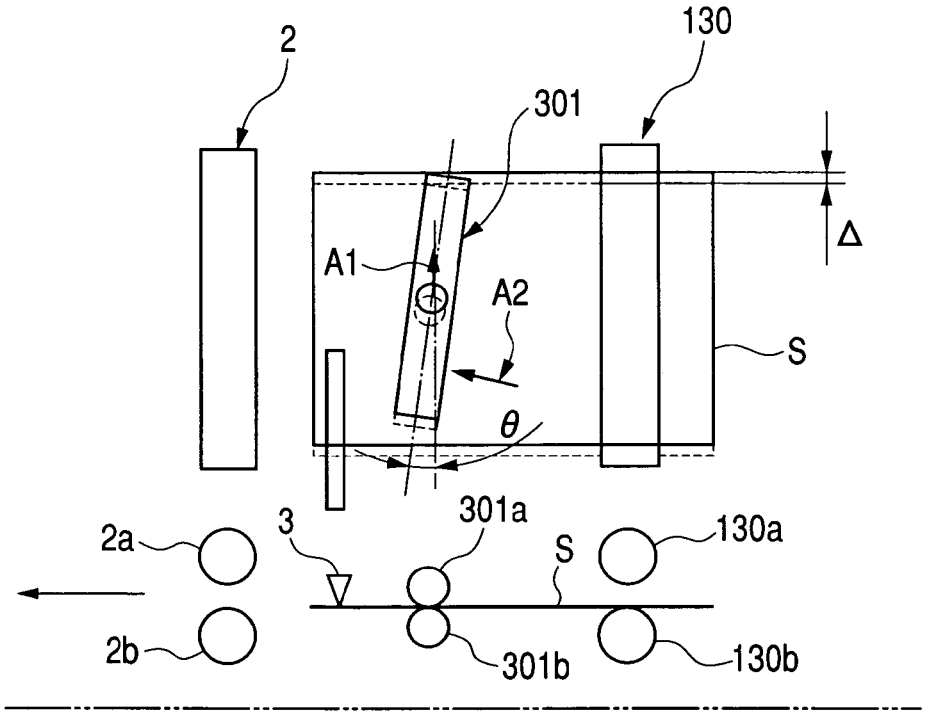
FIGS. 8A and 8B are a second drawing to explain about the skew conveying correction operation of the sheet conveying apparatus.

The downstream roller pair 2 and the upstream roller pair 130 are separated, respectively, in this manner, and the correction roller pair 301 is put into a state of nipping the sheet, and after that, as shown in FIG. 8A, the correction roller pair 301 is swung by an inclination θ (degrees) in an arrow mark A2 direction, and is moved in an arrow mark A1 by the amount < of the lateral reference deviation (Step 9). The correction of the sheet finishes before the leading edge of the sheet reaches the downstream roller pair 2.

Next, after such a correction is performed, before it is the time when the sheet leading edge searched previously in Step 7 reaches the downstream roller pair 2, the press-contacting/separating motor 405*b* is driven so that the upstream roller pair 130 and the downstream roller pair 2 are press-contacted and restored to a sheet nipping state, and the motor 404*b* is driven so as to separate the correction roller pair 301 (Step 10).

Figure 8B:
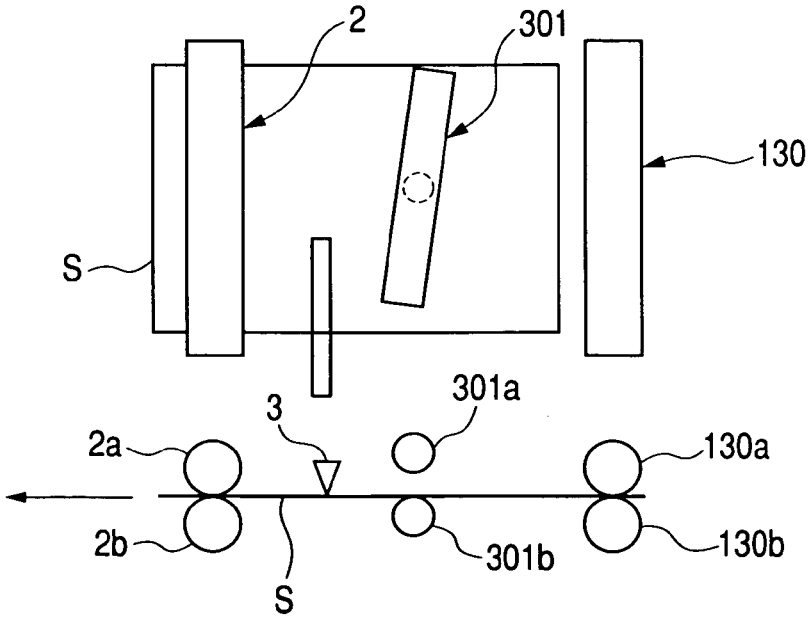

In this manner, the conveyance of the sheet S is continued by the upstream roller pair 130, and after that, the sheet S is further conveyed to the image forming portion 1003 at the downstream side by the downstream roller pair 2 nipping the sheet S as shown in FIG. 8B.

In this manner, the correction roller pair 301 is moved in a direction to correct the inclination of the sheet S in a state of nipping the sheet S in an inclined state based on the detection signal from the sheet position detection sensor 3, and at the time when the correction roller pair 301 moves, for example, similarly to the present embodiment, when the inclination of the sheet S is corrected in a state of the sheet S being nipped by the upstream roller pair 130, at least the upstream roller pair 130 is separated so as to release the sheet nipping state, so that the nipping state of the correction roller pair 301 is released after correcting the inclination of the sheet, and moreover, the upstream roller pair 130 released from the sheet nipping state is restored to the sheet nipping state, thereby making it possible to eliminate the tugging of the sheet S between the correction roller pair 301 and the upstream roller pair 130.

Consequently, when the correction roller pair 301 for correcting the skew conveying of the sheet S is moved, it is possible to prevent the crease on the sheet and the distortion in the image from occurring and perform a highly accurate skew conveying correction and a lateral reference correction. As a result, the print accuracy is improved, and the productivity can be enhanced. In addition, no loop sound is emitted, and a problem of the buckling at the time of the loop formation of the thin paper can be eliminated. Moreover, no loop space is needed, thereby making it possible to downsize the apparatus.

Second Embodiment

Next, a second embodiment of the present invention will be described.

Figure 9:
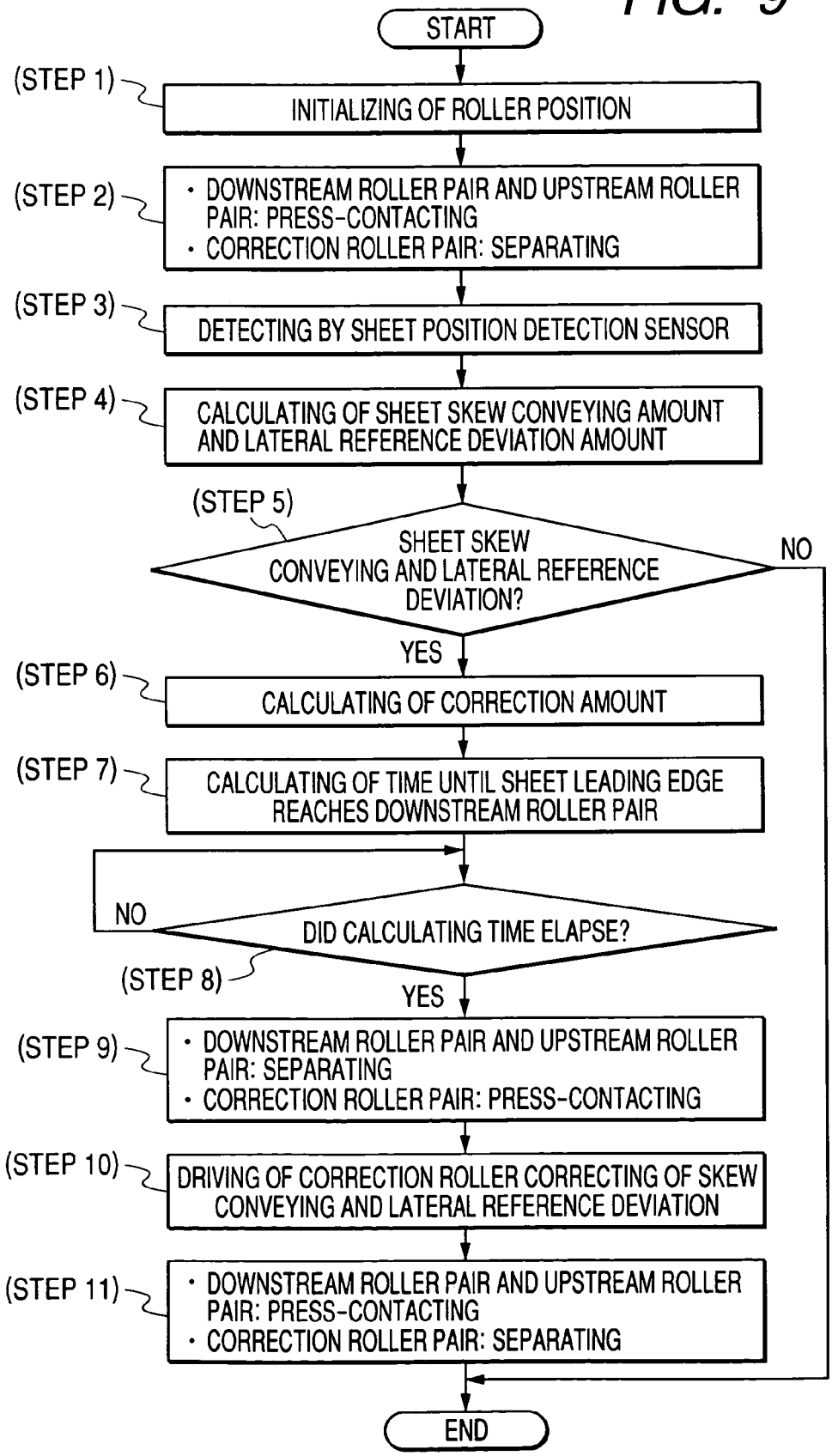
FIG. 9 is a flowchart to explain about the skew conveying correction operation of the sheet conveying apparatus according to a second embodiment of the present invention.

FIG. 9 is a flowchart showing a skew conveying correction operation of a sheet conveying apparatus according to the present embodiment, and a sheet skew conveying correction according to the present embodiment will be described with reference to the same drawing.

First, when an unillustrated start button of a printer 1000 is pushed, a lateral moving motor 20 and a swing motor 24 are driven, and by an unillustrated home position sensor, the initializing operation of the swing direction of a correction-roller pair 301 and the position in a thrust direction is performed (Step 1).

Accompanied with this initializing operation, a motor 404*b* is driven, and an upper correction roller 301*a* is lifted so as to separate from a lower correction roller 301*b*. Further, a press-contacting/separating motor 405*b* is driven so that a downstream roller pair 2 and a upstream roller pair 130 are press-contacted to one another (Step 2).

Figure 10A:
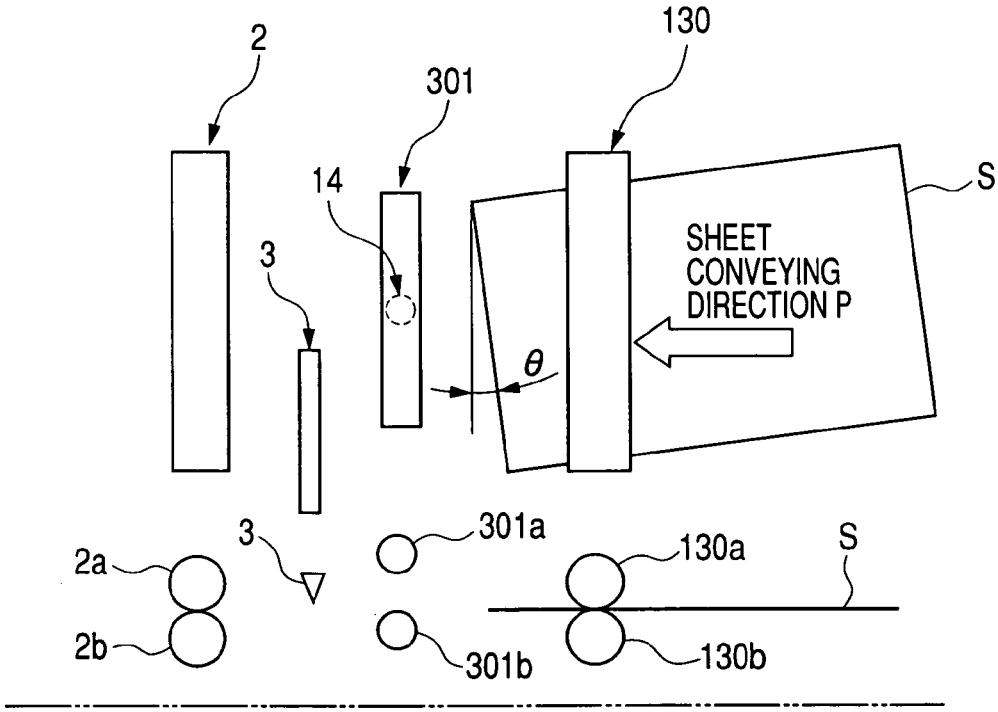
FIGS. 10A and 10B are a first drawing to explain about the skew conveying correction operation of the sheet conveying apparatus.

In this state, as shown in FIG. 10A, when a sheet S skewed by an angle θ (degrees) from a sheet conveying direction P is conveyed, this sheet S advances into the nip portion of a upstream roller pair 130 and is nipped there. After that, the sheet S nipped by the upstream roller pair 130 is conveyed along a sheet conveying direction P and advanced so as to be detected by a sheet position detection sensor 3 arranged in the downstream side of a upstream roller pair 130 (Step 3).

Here, the detection signal from this sheet position detection sensor 3 is inputted to a controller 120, and by a calculation circuit 401 of the controller 120, a passing time point of the sheet leading edge, the inclination of the sheet S nipped by the correction roller pair 301, and the amount of lateral reference deviation are calculated (Step 4).

Next, the controller 120 determines the existence or non-existence of the skew conveying and the lateral reference deviation of the sheet S from this calculation result (Step 5), and if there exists no skew conveying nor any lateral reference deviation of the sheet S (N of Step 5), no correction operation is performed, but if there exist the skew conveying and the lateral reference deviation of the sheet S (Y of Step 5), the amount of correction related to this, that is, the amount of driving of the lateral moving motor 20 and the swing motor 24 is calculated (Step 6).

Figure 10B:
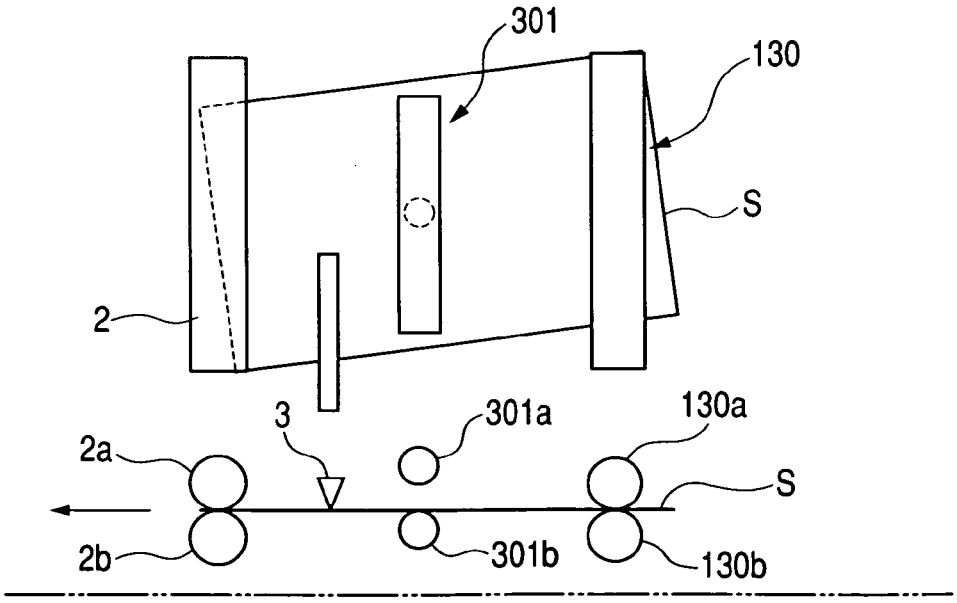
Figure 11A:
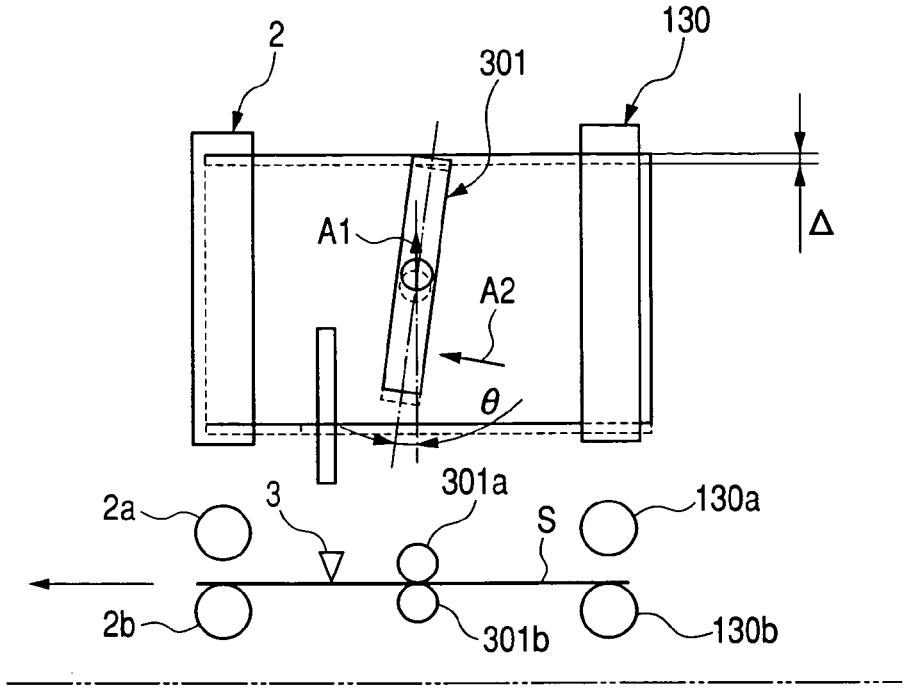
FIG. 11 is a second drawing to explain about the skew conveying correction operation of the sheet conveying apparatus.

Next, the time until the leading edge of the sheet S reaches a downstream roller pair 2 is calculated (Step 7), and when this calculation time has elapsed (Y of Step 8) and the leading edge of the sheet S reaches the downstream roller pair 2, as shown in FIG. 10B, the press-contacting/separating motor 405*b* is driven so as to separate the downstream roller pair 2 and the upstream roller pair 130, respectively, as shown in FIG. 11A, and a motor 404*b* is driven so that the correction roller pair 301 is put into a press-contacted state (Step 9).

The downstream roller pair 2 and the upstream roller pair 130 are separated, respectively, in this manner, and the correction roller pair 301 is put into a press-contacted, and after that, the correction roller pair 301 is swung by an inclination θ (degrees) in an arrow mark A2 direction, and is moved in an arrow mark A1 by the amount < of the lateral reference deviation (Step 10).

Figure 11B:
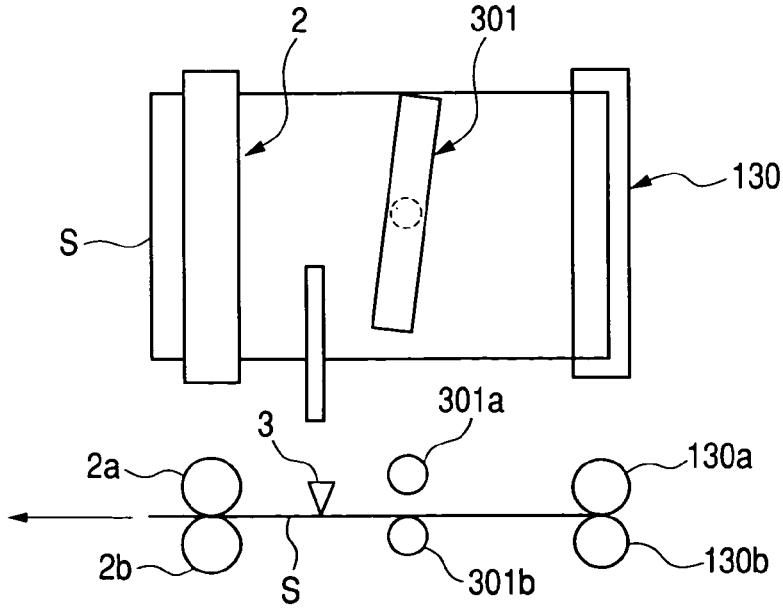

Next, after such a correction is performed, as shown in FIG. 11B, the press-contacting/separating motor 405*b* is driven so that the downstream roller pair 2 and the upstream roller pair 130 are press-contacted so as to nip the sheet S, and the motor 404*b* is driven so as to separate the correction roller pair 301 (Step 11).

Here, similarly to the present embodiment, if the constitution is such that the sheet S is nipped by the downstream roller pair 2 immediately after the sheet position is corrected, in addition to the advantages of the first embodiment previously described, there occurs almost no positional deviation of the sheet after the correction, and it is possible to perform a highly accurate skew conveying correction and a lateral reference correction.

Third Embodiment

Next, a third embodiment of the present invention will be described.

Figure 12:
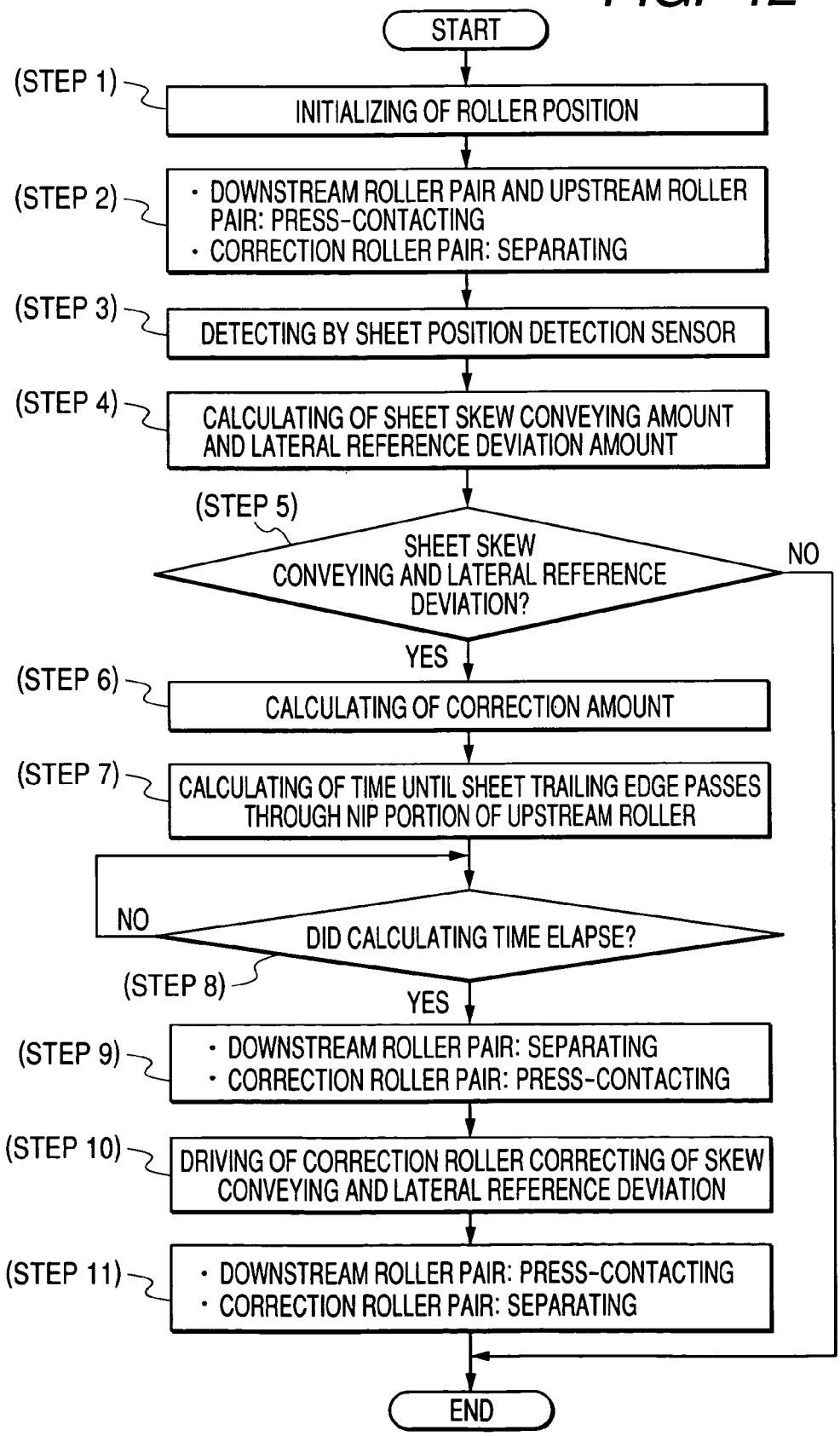
FIG. 12 is a flowchart to explain about the skew conveying correction operation of the sheet conveying apparatus according to a third embodiment of the present invention.

FIG. 12 is a flowchart showing a skew conveying correction operation of a sheet conveying apparatus according to the present embodiment, and the skew conveying correction of a sheet according to the present embodiment will be described with reference to the drawing.

First, when an unillustrated start button of a printer 1000 is pushed, a lateral moving motor 20 and a swing motor 24 are driven, and by an unillustrated home position sensor, the initializing operation of the swing direction of a correction roller pair 301 and the position in a thrust direction is performed (Step 1).

Accompanied with this initializing operation, a motor 404*b* is driven, and an upper correction roller 301*a* is lifted so as to separate from a lower correction roller 301*b*. Further, a press-contacting/separating motor 405*b* is driven so that a downstream roller pair 2 and a upstream roller pair 130 are press-contacted to one another (Step 2).

Figure 13A:
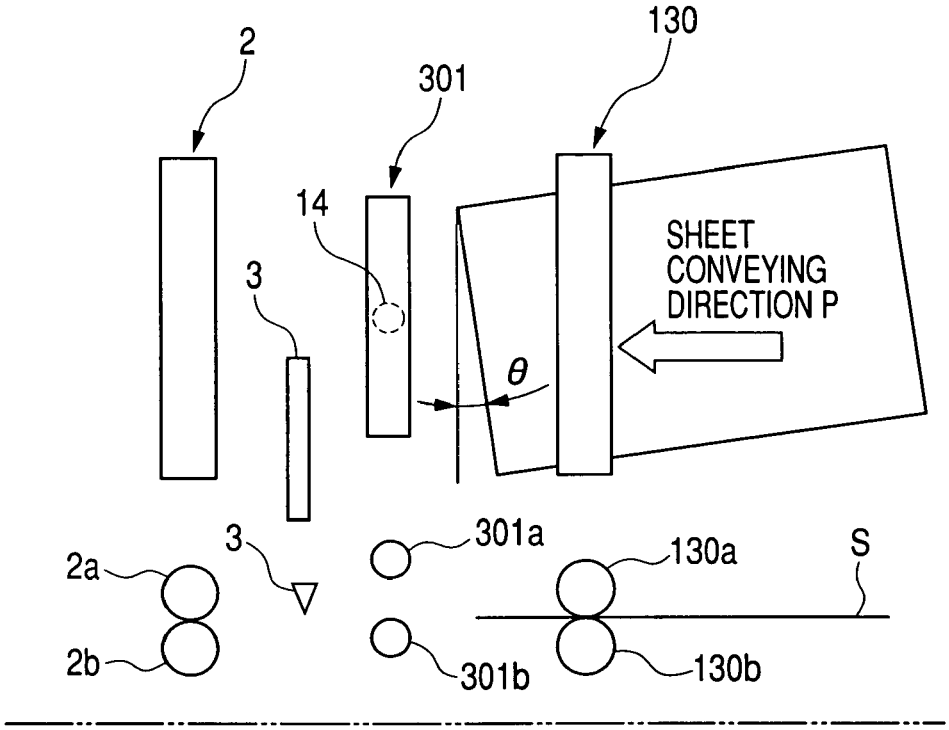
FIGS. 13A and 13B are a first drawing to explain about the skew conveying correction operation of the sheet conveying apparatus.

In this state, as shown in FIG. 13A, when a sheet S skewed by an angle θ (degrees) from a sheet conveying direction P is conveyed, this sheet S advances into the nip portion of a upstream roller pair 130 and is nipped there. After that, the sheet S nipped by the upstream roller pair 130 is, as shown in FIG. 13B, conveyed along the sheet conveying direction P and advanced so as to be detected by a sheet position detection sensor 3 arranged in the downstream side of a upstream roller pair 130 (Step 3).

Next, the detection signal from this sheet position detection sensor 3 is inputted to a controller 120, and by a calculation circuit 401 of the controller 120, a passing time point of a sheet leading edge, the inclination of the sheet S nipped by a correction roller pair 301, and the amount of lateral reference deviation are calculated (Step 4).

Next, the controller 120 determines the existence or non-existence of the skew conveying and the lateral reference deviation of the sheet S from this calculation result (Step 5), and if there exists no skew conveying nor any lateral reference deviation of the sheet S (N of Step 5), no correction operation is performed, but if there exist the skew conveying and the lateral reference deviation of the sheet S (Y of Step 5), the amount of correction related to this, that is, the amount of driving of the lateral moving motor 20 and the swing motor 24 is calculated (Step 6).

Figure 13B:
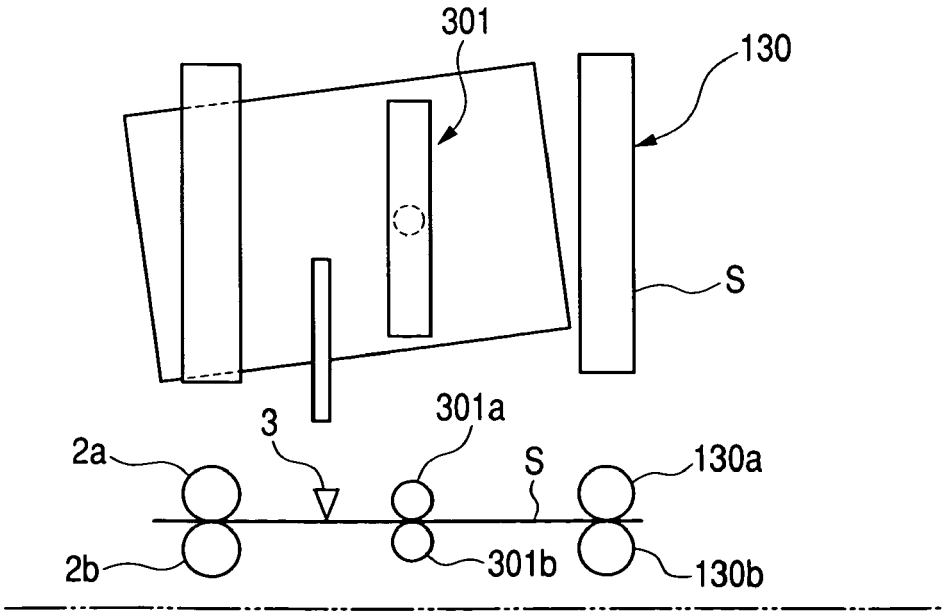
Figure 14A:
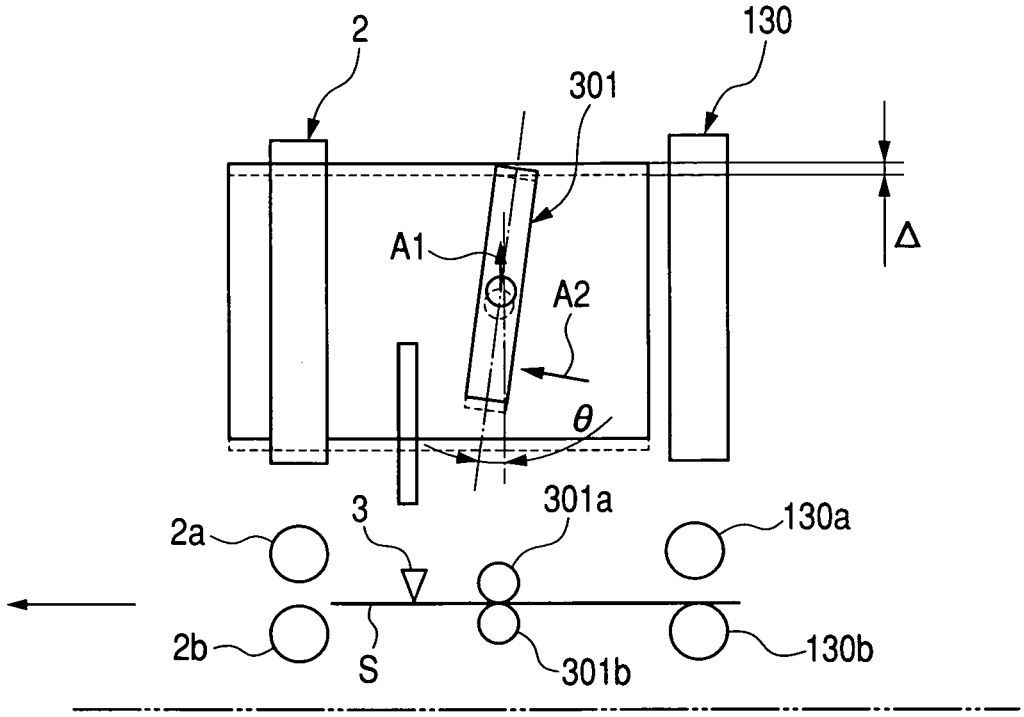
FIGS. 14A and 14B are a second drawing to explain about the skew conveying correction operation of the sheet conveying apparatus.
Figure 14B:
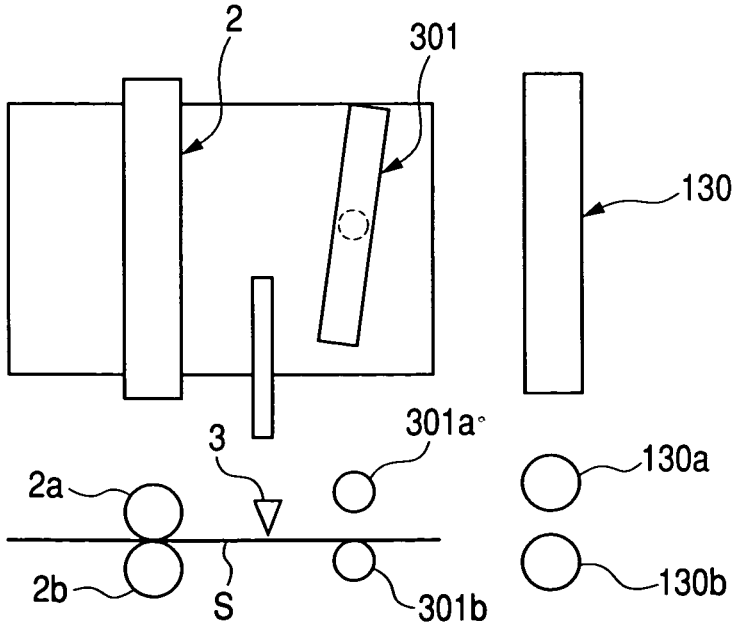

Next, the time until the tailing edge of the sheet S passes through the upstream roller pair 130 is calculated (Step 7), and when this calculation time has elapsed (Y of Step 8) and, as previously described in FIG. 13B, the tailing edge of the sheet S passes through the upstream roller pair 130, as shown in FIG. 14B, the press-contacting/separating motor 405*b* is driven so as to separate the downstream roller pair 2 and the upstream roller pair 130, respectively, and a motor 404*b* is driven so that the correction roller pair 301 is put into a press-contacted state (Step 9).

The downstream roller pair 2 and the upstream roller pair 130 are separated, respectively in this manner, and the correction roller pair 301 is put into a press-contacted state, and after that, the correction roller pair 301 is swung by an inclination θ (degrees) in an arrow mark A2 direction, and is moved in an arrow mark A1 by the amount < of the lateral reference deviation (Step 10).

Next, after such a correction is performed, as shown in FIG. 14B, the press-contacting/separating motor 405*b* is driven so that the downstream roller pair 2 and the upstream roller pair 130 are press-contacted so as to nip the sheet S, and the motor 404*b* is driven so as to separate the correction roller pair 301 (Step 11).

Here, similarly to the present embodiment, if the constitution is such that the correction of a sheet position is performed immediately after the tailing edge of the sheet S is pulled out from the nip portion of the upstream roller pair 130, in addition to the advantages of the first and second embodiments previously described, there occurs almost no catch due to the friction of the sheet S with the upstream roller 130*a* or the upstream roller 130*b* at the moving time of the sheet S for the position correction even when the conveying path between the correction roller pair 301 and the upstream roller pair 130 is formed in a bending shape. This makes it possible to perform a highly accurate skew conveying correction and a lateral reference correction even in a bending path portion.

Note that, in the present embodiment, the upstream roller pair 130 may be put into a press-contacted state after it is put into a state as shown in FIG. 14A. In this case, since the next sheet is made conveyable, the sheet can be conveyed with the sheet interval made short, thereby increasing a throughput.

Figure 15:
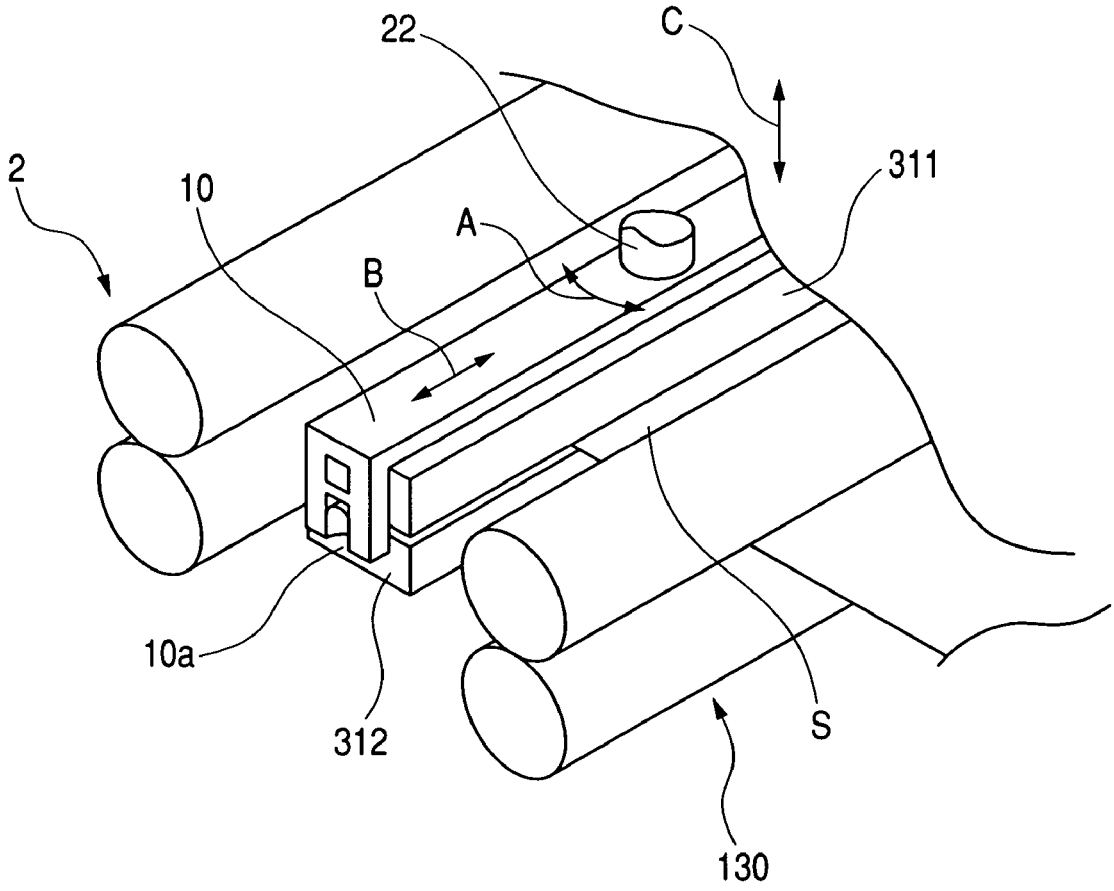
FIG. 15 is a perspective view showing another constitution of the inclination correction roller portion of the sheet conveying apparatus.

Note that, in the first to the third embodiments described so far, while the correction roller pair 301 comprising two contactably separable correction rollers 301*a* and 301*b* is used as inclination correction means, the present invention is not limited to this, but a roller pair comprising two contactably separable friction members 311 and 312 as shown in FIG. 15 may be used as the inclination correction means. This performs the correction of the positional deviation of the sheet by nipping the sheet by the two friction members 311 and 312 and allowing it to rotate and make a slide movement.

When such inclination correction means is used, though it is not possible to perform the correction while conveying the sheet, since there is no need for a motor for rotationally driving the inclination correction means, gear rows, and bearings, even if it is an inexpensive and simple constitution, it is possible to perform a highly accurate skew conveying correction and a lateral reference correction.

Further, in the descriptions made so far, while the application of the sheet conveying means to the image forming apparatus has been described in order that the sheet can be accurately conveyed to the image forming portion 1003 without an inclination and a positional deviation, the present invention is not limited to this, but for example, the sheet conveying means can be also adapted to the image reading apparatus in order that the sheet S can be accurately conveyed to the image reading portion for reading the sheet (original), which is a subsequent step with no inclination nor positional deviation.

What is claimed is:

1. A sheet conveying apparatus for conveying a sheet by a plurality of sheet conveying devices arranged along a sheet conveying path, said plurality of sheet conveying devices is controlled by control means, comprising:

detection means configured to detect an inclination to a sheet conveying direction of a sheet to be conveyed;

an inclination correction device configured to correct the inclination of the sheet by rotating the sheet based on a detection signal from said detection means;

a first conveying device, which is provided upstream of said inclination correction device, forms a first conveying nip, and conveys the sheet toward the inclination correction device;

a first nipping release device configured to release a nipping state of the first conveying nip of said first sheet conveying device;

a second sheet conveying device, which is provided downstream of said inclination correction device, forms a second conveying nip and conveys the sheet from the inclination correction device to the downstream; and a second nipping release device configured to release a nipping state of the second conveying nip of said second sheet conveying device;

wherein said first nipping release device and said second nipping release device are controlled to selectively release the sheet nipping state of the first conveying nip of said first sheet conveying device and the second conveying nip of said second sheet conveying device so that said first sheet conveying device and said second sheet conveying device do not nip a corrected sheet during a correction operation of the inclination of the sheet by said inclination correction device in a state in which the sheet is positioned simultaneously within the first conveying nip of said first sheet conveying device and the second conveying nip of said second sheet conveying device.

2. The sheet conveying apparatus according to claim 1, comprising a correction nipping release device configured to release a nipping state of said inclination correction device, wherein the nipping of said inclination correction device is released by said correction nipping release device when the sheet is conveyed by said first sheet conveying device and said second sheet conveying device.

3. The sheet conveying apparatus according to claim 1, comprising a correction nipping release device configured to release a nipping state of said inclination correction device, wherein a nipping state of the sheet conveying device nipping the sheet from among said first sheet conveying device and said second sheet conveying device is released by said first nipping release device and said second nipping release device when said inclination correction device corrects said inclination of the sheet, and the sheet nipping state of said inclination correction device is released by said correction nipping release device after the correction of the inclination of the sheet, and thereafter the sheet conveying device released from said sheet nipping state is restored to the nipping state so as to convey the sheet.

4. The sheet conveying apparatus according to claim 1, comprising a correction nipping release device configured to release a nipping state of said inclination correction device, wherein said first nipping release device and said second nipping release device is controlled to release the nipping of said first sheet conveying device and said second conveying device and said inclination correction device is controlled to perform the correction operation after the leading edge of the sheet reaches said second sheet conveying device and before a trailing edge of the sheet passes through said first sheet conveying device, and said correction nipping release device is controlled to release the nipping of said inclination correction device and said first sheet conveying device and said second sheet conveying device to nip the sheet again after the completion of the correction operation of said inclination correction device.

5. The sheet conveying apparatus according to claim 1, wherein said inclination correction device consists of a pair of separably press-contactable rotating device.

6. The sheet conveying apparatus according to claim 1, wherein the nipping operation and nipping release operation of the sheet by said first and second sheet conveying device are performed by the same drive device.

7. The sheet conveying apparatus according to claim 1, wherein said detection means can detect a lateral positional deviation, and said inclination correction device nips the sheet and is slidably movable in a direction to cross the sheet conveying direction, and said inclination correction device slide-moves so as to correct a positional deviation based on a detection signal by said detection means.

8. A sheet conveying apparatus for conveying a sheet by a plurality of sheet conveying devices arranged along a sheet conveying path, said plurality of sheet conveying devices is controlled by control means, comprising:

a sheet position detection sensor which detects an inclination to a sheet conveying direction of the sheet to be conveyed; and a correction roller device, which corrects an inclination of the sheet by rotating the sheet of an inclined state based on the detection signal from said sheet position detection sensor;

an upstream roller pair provided in the upstream of said correction roller device, the upstream roller pair forming an upstream nip and being separable;

a downstream roller pair provided in the downstream of said correction roller device, the downstream roller pair forming a downstream nip and being separable; and wherein said upstream roller pair and the downstream roller pair are selectively separated so that said upstream roller pair and downstream roller pair do not nip a corrected sheet during a correction operation of the inclination of the sheet by said correction roller device in a state in which the sheet is positioned simultaneously within the upstream nip of said upstream roller pair and the downstream nip of said downstream roller pair.

9. The sheet conveying apparatus according to claim 8, wherein said correction roller device is separably provided, and after the leading edge of the sheet reaches said downstream roller pair and before the trailing edge of the sheet passes through said upstream roller pair, said upstream roller pair and said downstream roller pair are separated so as to allow said correction roller device to perform the correction operation, and said correction roller device is separated and said upstream roller pair and said downstream roller pair to nip the sheet again after the completion of the correction operation of said correction roller device.

10. An image forming apparatus, comprising:

a sheet conveying apparatus according to any one of claims 1, 2, 3, 4, 5, 6 to 8, or 9.

an image forming portion for forming an image on the sheet to be conveyed by said sheet conveying apparatus.

* * * * *

UNITED STATES PATENT AND TRADEMARK OFFICE

CERTIFICATE OF CORRECTION

PATENT NO. : 7,422,209 B2
APPLICATION NO. : 10/885719
DATED : September 9, 2008
INVENTOR(S) : Hashimoto It is certified that error appears in the above-identified patent and that said Letters Patent is hereby corrected as shown below:

IN THE DRAWINGS:
Sheet No. 4, Figure 5, "CORRETION" (both occurrences) should read --CORRECTION--.

COLUMN 3:
Line 13, "conveying" should read --sheet conveying--.
Line 18, "convey" should read --conveying--.
Line 41, "a" should read --an--.
Line 43, "rable;" should read --rable; and--.
Line 46, "and" should be deleted.
Line 57, "a" (second occurrence) should read --an--.

COLUMN 4:
Line 1, "drawing" should read --pair of drawings--.
Line 4, "drawing" should read --pair of drawings--.
Line 10, "drawing" should read --pair of drawings--.
Line 19, "drawing" should read --pair of drawings--.
Line 22, "drawing" should read --pair of drawings--.

COLUMN 5:
Line 9, "a" should read --an--.
Line 10, "a" (first occurrence) should read --an--.

COLUMN 6:
Line 4, "a" (second occurrence) should read --an--.
Line 18, "its" should read --their--.
Line 41, "at angle" should read --angled--.
Line 60, "is corresponding" should read --corresponds--.

COLUMN 8:
Line 28, "control" should read --a control--.

COLUMN 10:
Line 36, "a" should read --an--.
Line 42, "a" should read --an--.

UNITED STATES PATENT AND TRADEMARK OFFICE

CERTIFICATE OF CORRECTION

PATENT NO. : 7,422,209 B2
APPLICATION NO. : 10/885719
DATED : September 9, 2008
INVENTOR(S) : Hashimoto It is certified that error appears in the above-identified patent and that said Letters Patent is hereby corrected as shown below:

COLUMN 11:
Line 40, “a” should read --an--.
Line 49, “a” should read --an--.
Line 66, “tailing edge” should read --tail end--.

COLUMN 12:
Line 2, “tailing edge” should read --tail end--.
Line 23, “tailing edge” should read --tail end--.

COLUMN 13:
Line 60, “is” should read --are--.

COLUMN 14:
Line 10, “device.” should read --devices.--.
Line 13, “device” should read --devices--.
Line 28, “and” should be deleted.
Line 35, “separable;” should read --separable; and --.
Line 38, “and” should be deleted.

Signed and Sealed this

Third Day of February, 2009

JOHN DOLL
*Acting Director of the United States Patent and Trademark Office*